US007175182B2

(12) United States Patent
Pan et al.

(10) Patent No.: US 7,175,182 B2
(45) Date of Patent: Feb. 13, 2007

(54) AUTOMATIC SCORE DARTBOARD ASSEMBLY

(75) Inventors: Francis Pan, Taichung Hsien (TW); Yen-Hwa Liao, Taichung Hsien (TW); John C. Pan, Taichung Hsien (TW)

(73) Assignee: Forhouse Corporation, Taichung Hsien (TW)

( * ) Notice: Subject to any disclaimer, the term of this patent is extended or adjusted under 35 U.S.C. 154(b) by 63 days.

(21) Appl. No.: 10/945,909

(22) Filed: Sep. 22, 2004

(65) Prior Publication Data

US 2006/0061039 A1 Mar. 23, 2006

(51) Int. Cl.
*F41J 3/02* (2006.01)

(52) U.S. Cl. ..... 273/408

(58) Field of Classification Search ..... 273/317, 273/348, 371, 376, 407–408
See application file for complete search history.

(56) References Cited

U.S. PATENT DOCUMENTS 4,789,932 A 12/1988 Cutler et al.

FOREIGN PATENT DOCUMENTS

| | | | |
|---|---|---|---|
| DE | 42 07 933 A | | 9/1992 |
| DE | 19539837 | | 4/1997 |
| DE | 197 01 781 A | | 7/1998 |
| DE | 19701781 | * | 7/1998 |
| EP | 1 323 999 A | | 4/2004 |
| ES | 2025007 | | 3/1992 |
| FR | 2712079 | | 5/1995 |
| FR | 2712079 | * | 5/2005 |
| WO | WO 97/15802 A | | 5/1997 |
| WO | WO 98/31979 | | 7/1998 |

* cited by examiner

*Primary Examiner*—Kim Nguyen
(74) *Attorney, Agent, or Firm*—Bacon & Thomas

(57) ABSTRACT

An automatic score dartboard assembly has a base, a dartboard, a support, at least one imaging element and a main control circuit. The dartboard and the support are attached to the base, and the at least one imaging element is mounted on the support to capture a direct viewing image of the dartboard periodically. The images are output to the main control circuit to determine the score of a dart when the dart sticks in the dartboard. The main control circuit is composed of an image processor and a memory device. The image processor uses an image comparison method to determine the score of the dart. Therefore, the present invention uses as few as one imaging element to determine the score and increases accuracy of determining score.

9 Claims, 6 Drawing Sheets

AUTOMATIC SCORE DARTBOARD ASSEMBLY

BACKGROUND OF THE INVENTION

1. Field of the Invention

The present invention relates to a dartboard assembly and more particularly to a dartboard having automatic score capability.

2. Description of Related Art

With reference to FIG. 9, a prior art of automatic score dartboard assembly (50) has a dartboard (51), three light sources (52*a*, 52*b*, 52*c*) and three angle sensors (53*a*, 53*b*, 53*c*). The dartboard (51) has a front face (not numbered) and multiple segments (not numbered) in a circular scoring area (not numbered) on the front face. An equilateral triangle (A-B-C) is circumscribed tangentially on the scoring area of the dartboard (51) and has three vertices (A, B, C) coplanar with the face of the dartboard (51) and three sides (A-B, B-C, C-A) of equal length. The angle sensors (53*a*, 53*b*, 53*c*) are mounted respectively at corresponding vertices (A, B, C) of the equilateral triangle. The three light sources (52*a*, 52*b*, 52*c*) are mounted around the dartboard (51) between and coplanar with the vertices (A, B, C) and correspond respectively to the angle sensors (53*a*, 53*b*, 53*c*). For example, the light source (52*a*) between vertices B and C is opposite to the angle sensor (53*a*) at vertex A.

Since the light sources (52*a*, 52*b*, 52*c*) and the angle sensors (53*a*, 53*b*, 53*c*) are coplanar with the face of the dartboard (51), a dart (54) embedded in the face of the dartboard (51) will cast a shadow on at least one of the angle sensor (53*a*, 53*b*, 53*c*). By detecting the light emitting from which corresponding position on the light source (52*a*, 52*b*, 52*c*) was blocked, one can determine the position of a dart (54) embedded in the face of the dartboard (51). When any two angle sensors (53*a* and 53*b*, 53*b* and 53*c*, 53*a* and 53*c*) detect a dart (54) embedded in the face of the dartboard (51) and measure the angle to the dart (54) from each angle sensor, The angles and the known length of the sides (A-B, B-C, C-A) are used to calculate the exact position of the dart (54) on the face of the dartboard (51). Then the score of the dart (54) will be calculated.

Furthermore, this prior art of the dartboard assembly (50) often uses more than three angle sensors (53*a*, 53*b*, 53*c*) to calculate the scores of many darts (54) simultaneously embedded in the face of the dartboard (51).

To increase the accuracy of the angle sensor (53*a*, 53*b*, 53*c*), each angle sensor (53*a*, 53*b*, 53*c*) is composed of a charge capacitor device (CCD) and a lens (not shown), so the angle sensors (53*a*, 53*b*, 53*c*) of the conventional dartboard (51) are not cheap. Moreover, the alignment between the light sources (52*a*, 52*b*, 52*c*) and the corresponding angel sensors (53*a*, 53*b*, 53*c*) are critical to the accuracy of position determination, yet to achieve an exact alignment is a difficult process.

To overcome the shortcomings, the present invention provides an automatic score dartboard assembly to mitigate or obviate the aforementioned problems.

SUMMARY OF THE INVENTION

The main objective of the present invention is to provide a dartboard assembly that has an automatic score capability that accurately determines the position of a dart on the dartboard and then calculates the score of the dart.

The automatic score dartboard assembly in accordance with the present invention has a base, a dartboard, a support, at least one imaging element and a main control circuit. The dartboard and the support are attached to the base, and the at least one imaging element is mounted on the support to capture a direct viewing image of the dartboard periodically. The images are output to the main control circuit to determine the score of a dart when a dart sticks in the dartboard. The main control circuit is composed of an image processor and a memory device. The image processor uses an image comparison method to determine the score of the dart. Therefore, the present invention uses only one imaging element to determine the score and increases the accuracy of determining the score.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
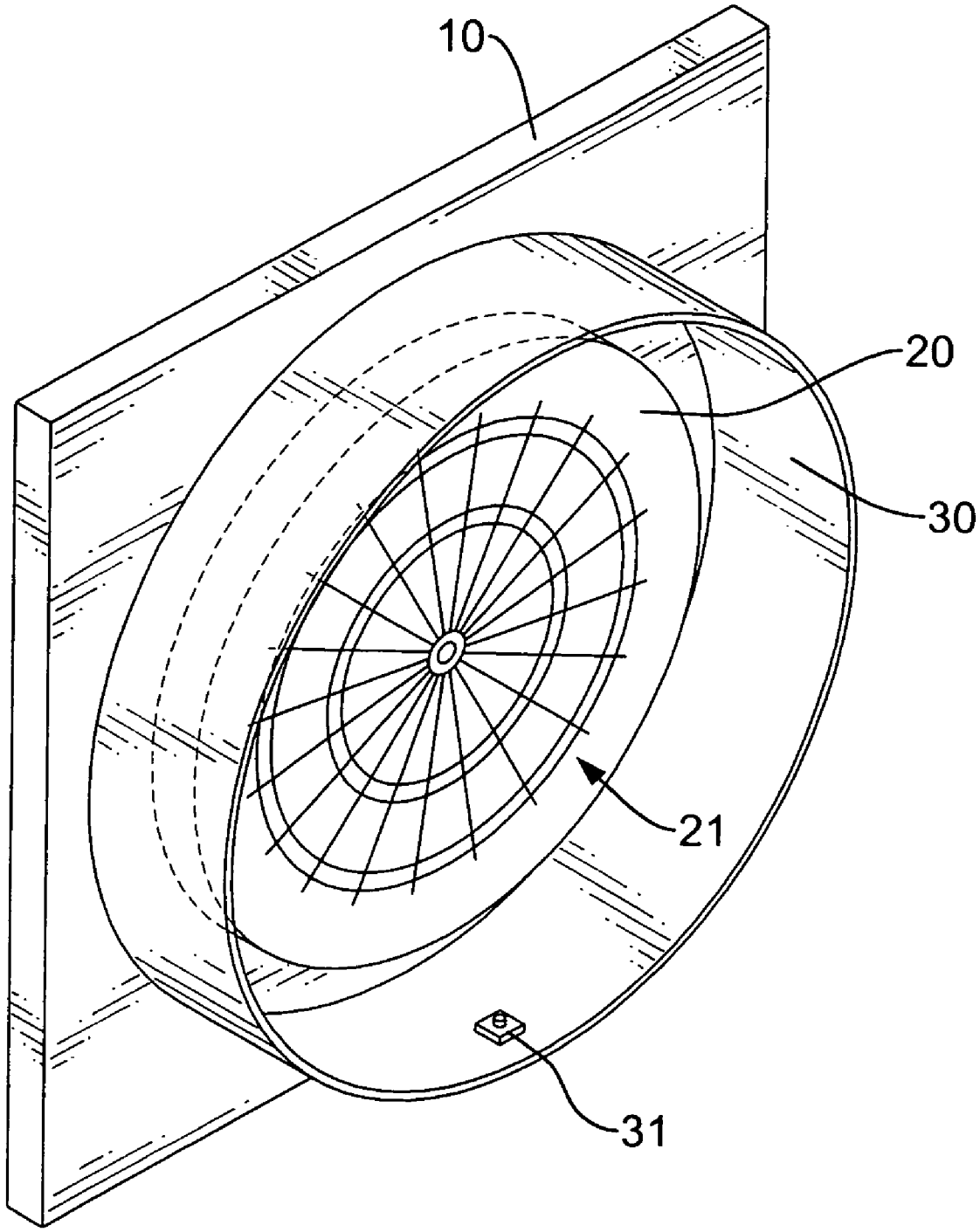
FIG. 1 is a perspective view of a first embodiment of a dartboard assembly in accordance with the present invention.
Figure 8:
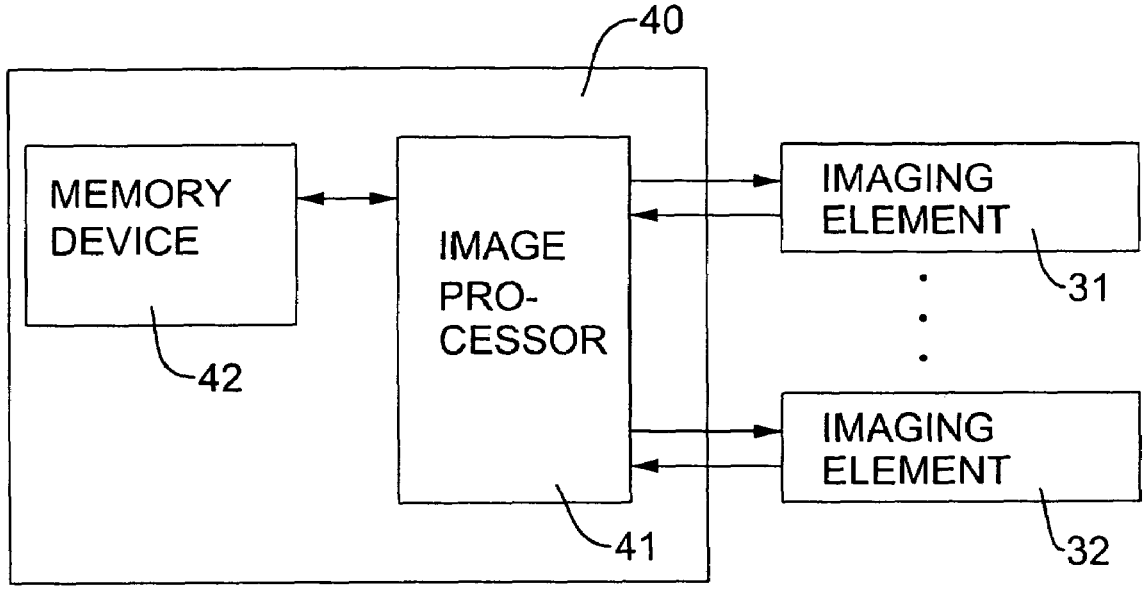
FIG. 8 is a functional block diagram of the dartboard assembly in accordance with the present invention.
Figure 9:
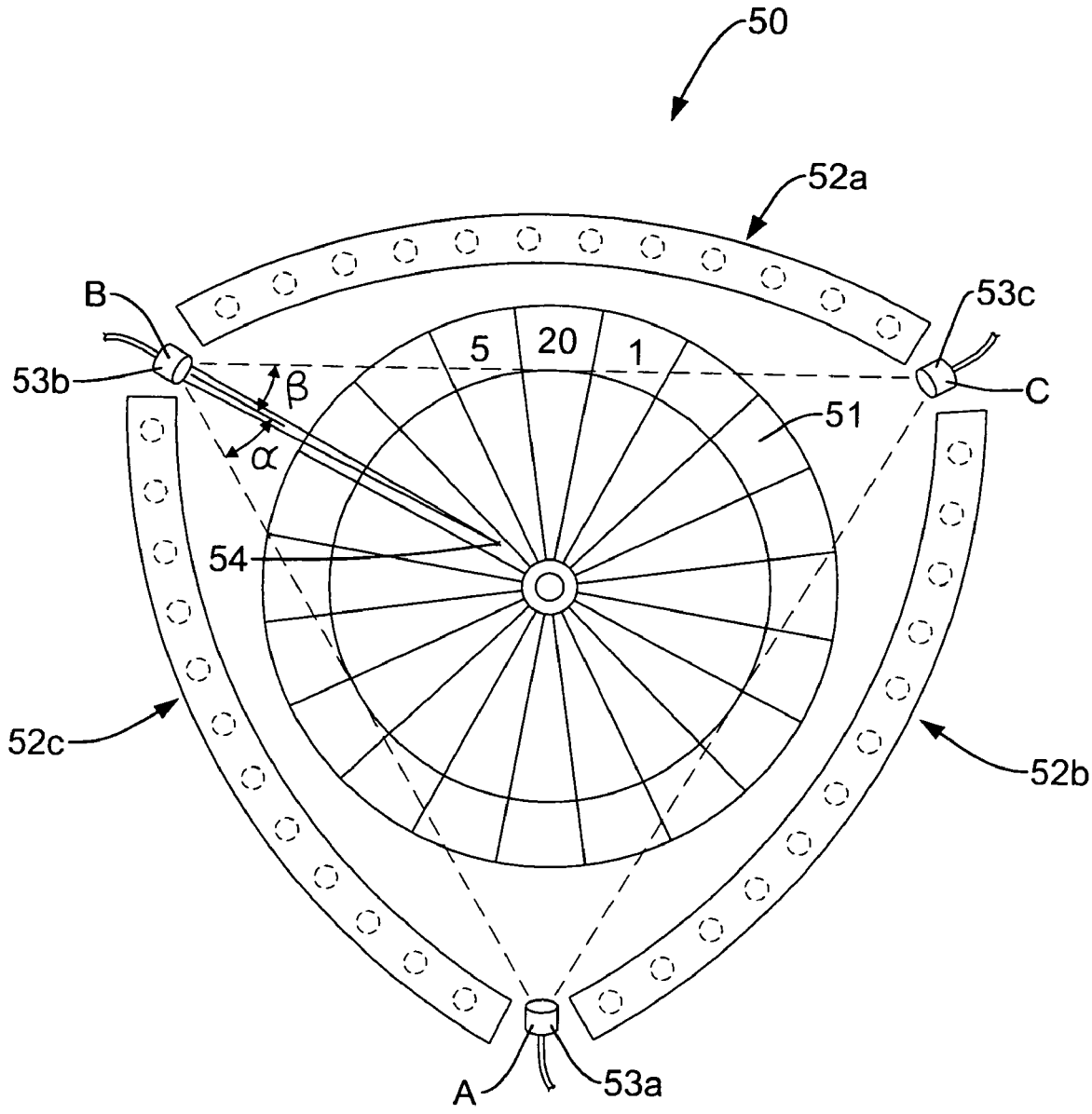
FIG.9 PRIOR ART
FIG. 9 is a front view of a conventional dartboard assembly in accordance with the prior art.

With reference to FIGS. 1 and 8, an automatic score dartboard assembly in accordance with the present invention has a base (10), a dartboard (20), a support (30), at least one imaging element (31) and a main control circuit (40).

The dartboard (20) is circular, is attached to the base (10) and has a thickness, an outer edge and a front face (21) divided into multiple score segments.

The support (30) is attached to the base (10) and has a height and an inside surface. The support (30) is mounted around the dartboard (20) at a specific distance from the outer edge of the dartboard (20). The height of the support (30) is larger than the thickness of the dartboard (20). The support (30) is usually circular.

The at least one imaging element is attached to the inside surface of the support (30) and has a specific field of view to obtain a direct viewing image of the front face (21) of the dartboard (20).

Figure 2:
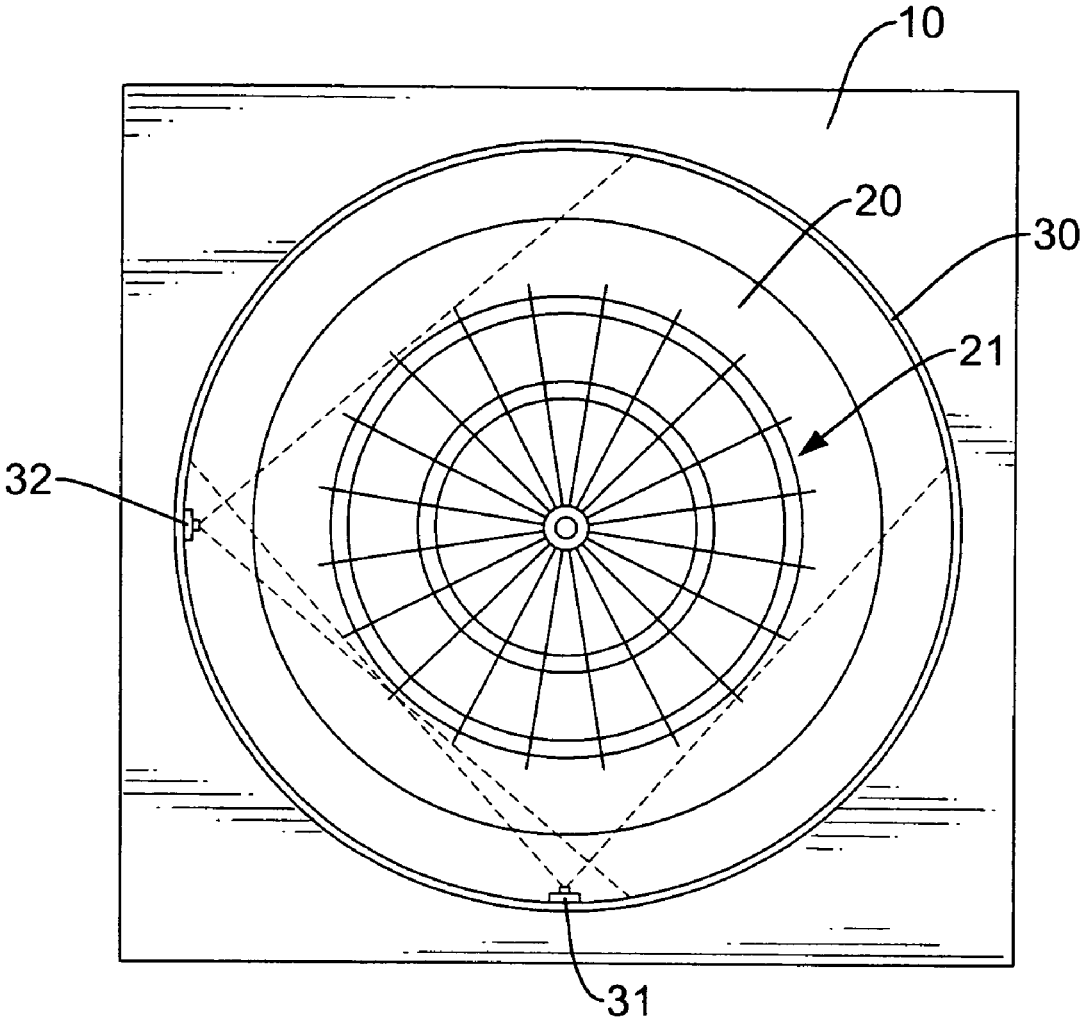
FIG. 2 is a side view in partial section of the dartboard assembly in FIG. 1.

With further reference to FIG. 2, a first embodiment of the dartboard assembly in accordance with the present invention only has one imaging element (31) with a specific field of view. The imaging element (31) is attached to the inside surface of the support (30) higher than the front face (21) of the dartboard (20) so the field of view of the imaging element (31) encompasses all score segments on the top face (21) of the dartboard (20). The imaging element (31) may be a charge-couple device (CCD) imager or a complementary metal oxide semiconductor (COMS) imager The main control circuit (40) mainly has an image processor (41) and a memory device (42) connected to allow two-way communication. The image processor (41) is connected to the imaging element (31) to periodically obtain an image of the front face (21) of the dartboard (20).

Figure 4B:
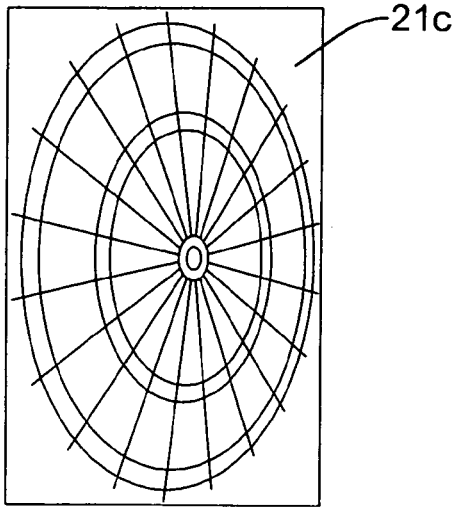
FIG. 4B is another image of the dartboard taken by the other imaging element in the dartboard assembly in FIG. 3.
Figure 4A:
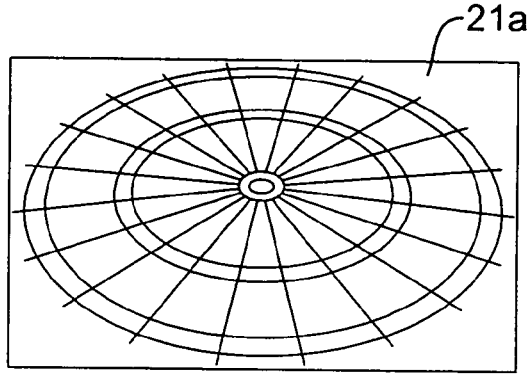
FIG. 4A is an image of a dartboard taken by one imaging element in the dartboard assembly in FIG. 3.

With further reference to FIG. 4A, one image of the front face (21) of the dartboard (21) without any darts (22) is obtained from the imaging element (31) and is stored in the memory device (42). The image is used as a baseline front face image (21*a*) for later comparison. The baseline front face image (21*a*) is divided to many areas conforming to the score segments on the front face (21). Each area of the baseline front face image (21*a*) is defined by a unique range of coordinates stored in the memory device (42). Further, the scores corresponding to the areas are also stored in the memory device (42).

The imaging element (31) obtains an image of the top face (21) of the dartboard (20) periodically and outputs the new image to the image processor (41). The image processor (41) records each new image from the imaging element (31) and compares each new image to the baseline front face image (21*a*) to find any difference between the two images.

Figure 5B:
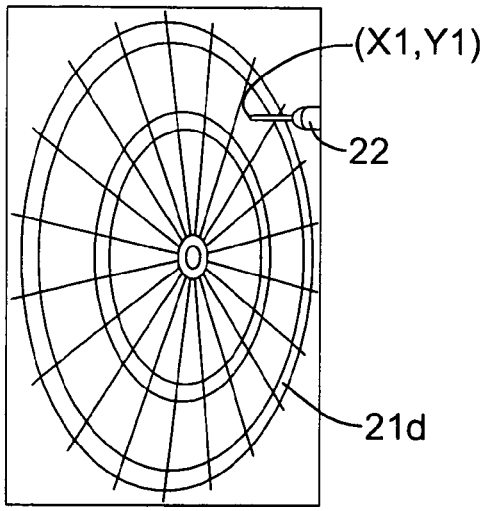
FIG. 5B is another image of a dart stuck in the dartboard taken by the other imaging element in the dartboard assembly in FIG. 3.
Figure 5A:
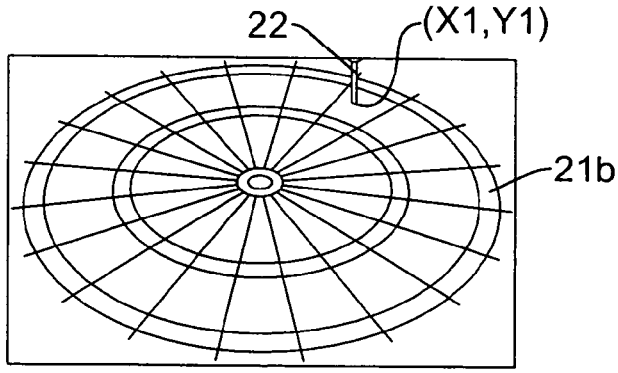
FIG. 5A is an image of a dart stuck in a dartboard taken by one imaging element in the dartboard assembly in FIG. 3.

With further reference to FIGS. 4A and 5A, the image processor (41) finds a difference between the new image (21*b*) and the baseline front face image (21*a*) when a dart (22) is stuck in the front face (21) of the dartboard (20). The image processor (41) obtains the coordinates of the difference (X1, Y1) and compares the coordinates to the areas of the baseline front face image (21*a*) to determine in which area the coordinate belong. Therefore, the image processor (41) can determine the score corresponding to the area.

To increase the accuracy of determining the coordinates of the dart in the new image (21*b*), the score segments on the front face (21) are contrasting colors.

Figure 3:
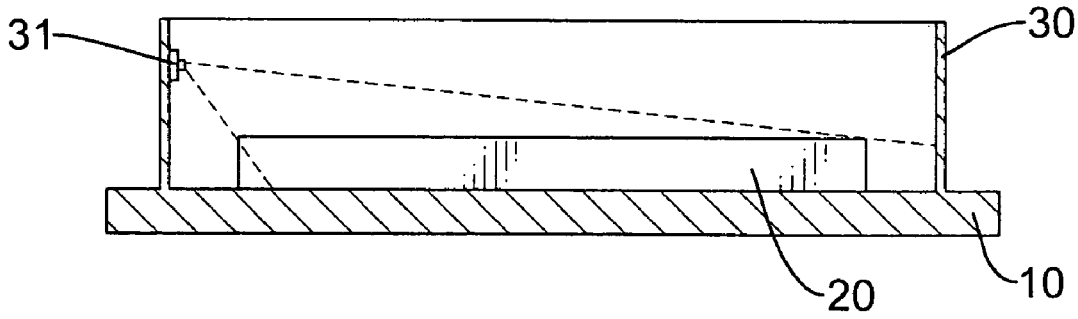
FIG. 3 is a front view of a second embodiment of a dartboard assembly in accordance with the present invention.

With reference to FIG. 3, a second embodiment of the automatic score dartboard assembly in accordance with the present invention has all the elements previously described in the first embodiment plus another imaging element (32). The additional imaging element (32) is also mounted on the support (30) and has a field of view the same as the other imaging element (31). The two imaging elements (31, 32) are mounted on the support (30) so the fields of view are perpendicular to one another. With further reference to FIG. 4B, two images (21*a*, 21*c*) are obtained respectively by the two imaging elements (31, 32). The two imaging elements (31, 32) can provide more accuracy when determining the score of a particular dart (22). With further reference to FIG. 5B, two baseline front face images (21*a*, 21*c*) are stored in the memory device (42). When a dart (22) sticks in the dartboard (10), two new images (21*b*, 21*d*) will be obtained respectively by the two imaging elements (31, 32), and the two new images (21*b*, 21*d*) are output to the image processor (41). The image processor (41) compares the two new images (21*b*, 21*d*) respectively to the two baseline front face images (21*a*, 21*b*) to determine the score of the dart (22).

Figure 6:
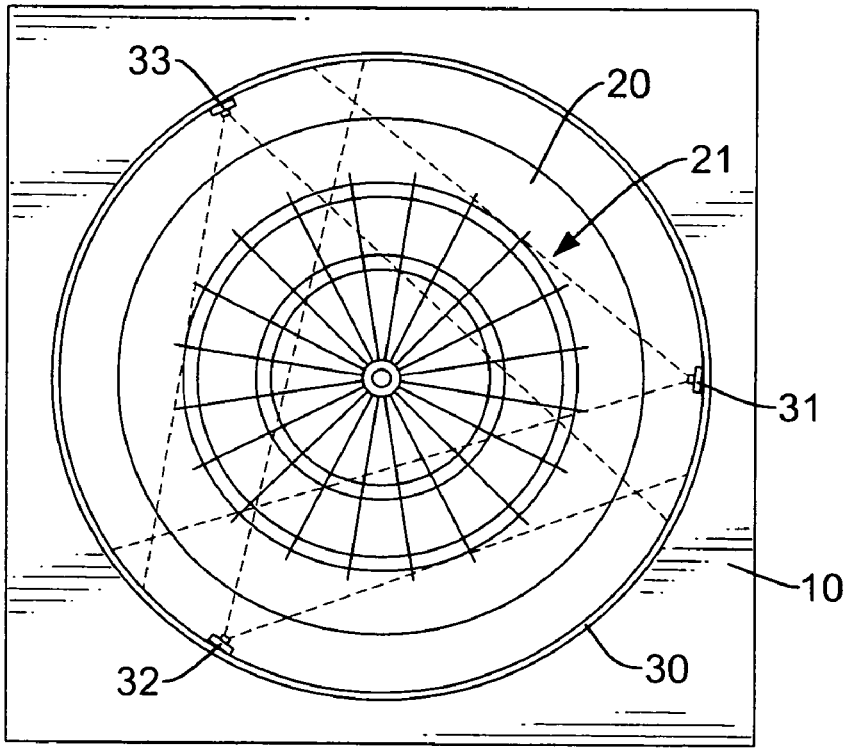
FIG. 6 is a front view of a third embodiment of a dartboard assembly in accordance with the present invention.
Figure 7:
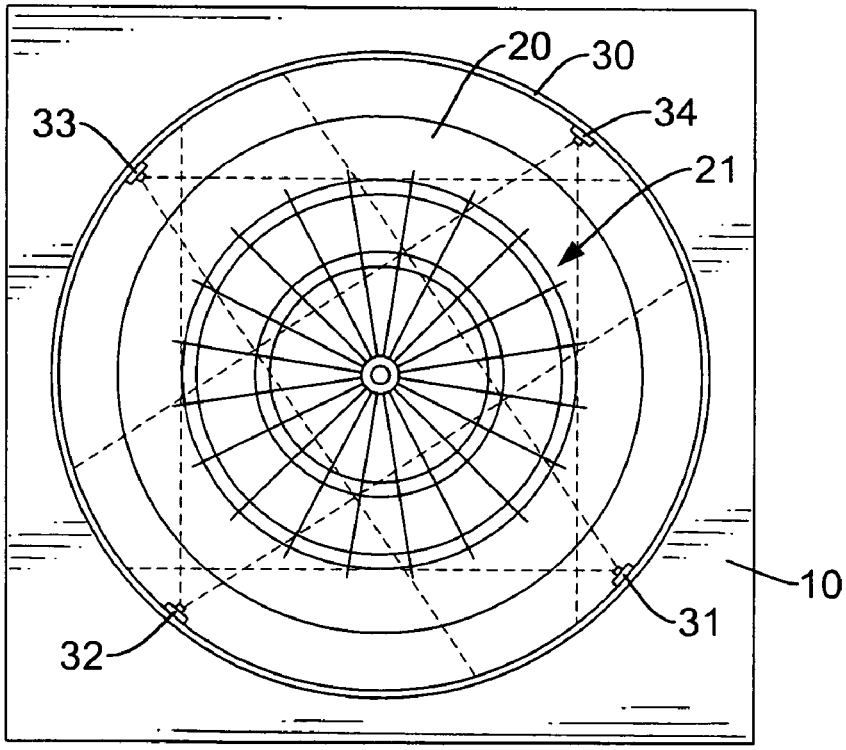
FIG. 7 is a front view of a fourth embodiment of a dartboard assembly in accordance with the present invention.

With reference to FIGS. 6 and 7, a third and fourth embodiment of the automatic score dartboard assembly in accordance with the present invention use three or four imaging elements (31~34) for larger dartboards (20) or to use imaging elements (31~34) with a smaller field of view. The imaging elements (31~34) are attached to and equally spaced on the support (30). The fields of view of the imaging elements (31~34) overlap so imaging elements (31~34) do not have to be wide-angle type imagers.

Based on the forgoing description, the present invention only needs one imaging element to determine the score of a dart and does not use light sources so the structure of the automatic score dartboard device simplified. In addition, the present invention uses an image comparison method to determine the score of the dart, so the accuracy of the determining score will be increased.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An automatic score dartboard assembly, comprising:

a base;

a circular dartboard attached to the base and having a thickness, an outer edge and a front face divided into multiple score segments;

a support attached to the base around the circular dartboard at a specific distance from the outer edge of the dartboard and having a height larger than the thickness of the circular dartboard and an inside surface;

at least one imaging element with a specific field of view attached to the inside surface of the support higher than the front face of the dartboard to obtain an image of the front face of the circular dartboard; and a main control circuit having an image processor and a memory device connected to allow two-way communication, wherein the image processor is connected to the at least one imaging element to periodically obtain an image of the front face of the circular dartboard, and the memory device stores at least one baseline front face image to compare with each new image obtained from the at least one imaging element to determine a dart's score.

2. The dartboard assembly as claimed in claim 1, wherein only one imaging element is attached to the support.

3. The dartboard assembly as claimed in claim 1, wherein two imaging elements are attached to the support with their fields of view perpendicular to each another.

4. The dartboard assembly as claimed in claim 1, wherein three imaging elements are attached to and equally spaced on the support.

5. The dartboard assembly as claimed in claim 1, wherein four imaging elements are attached to and equally spaced on the support.

6. The dartboard assembly as claimed in claim 1, wherein the support is circular.

7. The dartboard assembly as claimed in claim 1, wherein each at least one imaging element is a charge-coupled device (CCD) imager.

8. The dartboard assembly as claimed in claim 1, wherein each at least one imaging element is a complementary metal oxide semiconductor (COMS) imager.

9. The dartboard assembly as claimed in claim 1, wherein the score segments are contrasting colors.

* * * * *